US010711656B2

(12) United States Patent
Kakuda et al.

(10) Patent No.: US 10,711,656 B2
(45) Date of Patent: Jul. 14, 2020

(54) CONTROL APPARATUS OF VALVE OPENING/CLOSING TIMING CONTROL MECHANISM

(71) Applicant: AISIN SEIKI KABUSHIKI KAISHA, Kariya-shi, Aichi-ken (JP)

(72) Inventors: Yuji Kakuda, Nagoya (JP); Toshiki Sato, Takahama (JP); Shogo Katsuki, Nagoya (JP); Yugo Kurahashi, Nagoya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 0 days.

(21) Appl. No.: 16/376,019

(22) Filed: Apr. 5, 2019

(65) Prior Publication Data

US 2019/0316497 A1 Oct. 17, 2019

(30) Foreign Application Priority Data

Apr. 12, 2018 (JP) ..... 2018-076773

(51) Int. Cl.
*F01L 1/34* (2006.01)
*F01L 1/344* (2006.01)
*F02D 13/02* (2006.01)

(52) U.S. Cl.
CPC ..... *F01L 1/344* (2013.01); *F02D 13/0219* (2013.01); *F01L 2201/00* (2013.01); *F01L 2810/04* (2013.01)

(58) Field of Classification Search
CPC ..... F02D 13/0219; F02D 41/009; F02D 2041/001; F02D 2041/2041; F01L 1/344; F01L 1/352; F01L 2001/0537; F01L 2810/04; F01L 2250/04; F01L 2820/032; F01L 2201/00
See application file for complete search history.

(56) References Cited

U.S. PATENT DOCUMENTS 8,261,707 B2 * 9/2012 Watanabe ..... F02D 13/0219 123/90.15
2012/0318223 A1 * 12/2012 Stewart ..... F02D 13/00 123/90.17

FOREIGN PATENT DOCUMENTS

JP 2008208763 A 9/2008
JP 2015132178 A 7/2015

* cited by examiner

*Primary Examiner* — Zelalem Eshete
(74) *Attorney, Agent, or Firm* — Buchanan Ingersoll & Rooney PC

(57) ABSTRACT

A control apparatus of a valve opening/closing timing control mechanism, configured by including driving side and driven side rotating bodies; a stopper unit; and an electric motor, includes: a phase controller controlling an electric motor to reduce, when a target phase is set, a deviation between the target phase and a current first actual phase and reducing power to be supplied to the electric motor as the deviation decreases; and a control target setting unit setting a first target phase displaced to a side of the first actual phase in an operation direction where the deviation is reduced when the target phase is set to a most retarded or most advanced angle phase, in which the phase controller executes a first phase control of reducing a deviation between the set first target phase and the current first actual phase.

4 Claims, 10 Drawing Sheets

CONTROL APPARATUS OF VALVE OPENING/CLOSING TIMING CONTROL MECHANISM

CROSS REFERENCE TO RELATED APPLICATIONS

This application is based on and claims priority under 35 U.S.C. § 119 to Japanese Patent Application 2018-076773, filed on Apr. 12, 2018, the entire contents of which are incorporated herein by reference.

TECHNICAL FIELD

This disclosure relates to a control apparatus of a valve opening/closing timing control mechanism that controls the opening/closing timing of a valve of a combustion chamber of an internal combustion engine by an electric motor.

BACKGROUND DISCUSSION

As a valve opening/closing timing control mechanism having the above-described configuration, JP 2005-132178 A (Reference 1) discloses a technology that includes a driving side rotating body (driving rotating body in the document) that rotates synchronously with a crankshaft of an internal combustion engine, a driven side rotating body (driven rotating body in the document) that rotates integrally with a camshaft that opens and closes a combustion chamber of the internal combustion engine, and an electric motor that sets a relative rotation phase between the rotating bodies, and further includes a controller (control unit in the document) that controls the electric motor.

In Reference 1, a stopper structure is provided, which stops displacement of the relative rotation phase by mechanical contact even when the relative rotation phase of the driven side rotating body with respect to the driving side rotating body reaches any of the most retarded angle and the most advanced angle. Then, when a control is performed to set the relative rotation phase to the most retarded angle or the most advanced angle, a control is performed to reduce a contact speed in the stopper structure by repeating second energization and third energization in an on-off control after performing first energization by the control unit.

As described in Reference 1, the technology of having the stopper structure in order to determine an operation limit when the relative rotation phase between the driving side rotating body and the driven side rotating body reaches the most retarded angle and when the relative rotation phase reaches the most advanced angle is common.

In the internal combustion engine, the relative rotation phase may be set to, for example, the most retarded angle based on the operating state of the engine, and in the control of setting in this way, when the relative rotation phase is displaced at a high speed, mechanical impulsive sound may be generated in the region of a stopper.

For example, in a case where the controller is capable of setting a control form so as to reduce a voltage to be supplied to the electric motor when a deviation of the relative rotation phase is smaller as in PID control, for example, using an electric motor the rotational speed of which increases in proportion to an increase in the voltage of power to be supplied, such as a brushless DC motor, it is considered that it is possible to match the rotational speed of the electric motor with the rotational speed of the camshaft at the time at which the relative rotation phase reaches the most retarded angle, and as a result, to reduce an impact in the stopper.

However, in consideration of a delay in detection by a sensor that detects the relative rotation phase between the driving side rotating body and the driven side rotating body and a delay in control by the controller, it is also considered that the stopper generates impulsive sound when a control target is the most retarded angle or the most advanced angle. In such control generating impulsive sound, it is also considered that the valve opening/closing timing control mechanism may be damaged and that the performance of controlling the opening/closing timing of a valve may deteriorate.

Thus, a need exists for a control apparatus which is not susceptible to the drawback mentioned above.

SUMMARY

A feature of a control apparatus of a valve opening/closing timing control mechanism according to an aspect of this disclosure resides in that the valve opening/closing timing control mechanism is configured by including: a driving side rotating body configured to rotate synchronously with rotation of a crankshaft of an internal combustion engine, a driven side rotating body configured to rotate integrally with a camshaft for opening or closing of a valve that opens or closes a combustion chamber; a stopper unit configured to determine a mechanical operation limit on a most retarded angle side and a mechanical operation limit on a most advanced angle side of the driven side rotating body with respect to the driving side rotating body; and an electric motor configured to control a relative rotation phase between the driving side rotating body and the driven side rotating body, and that the control apparatus includes: a phase controller configured to control the electric motor to reduce, when a target phase is set, a deviation between the target phase and a current first actual phase detected by a phase detection unit that detects the relative rotation phase and to reduce power to be supplied to the electric motor as the deviation decreases; and a control target setting unit configured to set, instead of the target phase, a first target phase displaced from the target phase to a side of the first actual phase by a set angle in an operation direction in which the deviation is reduced when the target phase is set to a most retarded angle phase or a most advanced angle phase that is an operation limit of the stopper unit, wherein the phase controller executes a first phase control that is a phase control of reducing a deviation between the set first target phase and the current first actual phase.

According to this characteristic configuration, for example, when the most retarded angle phase is set as the target phase, the control target setting unit sets, instead of the target phase, the first target phase displaced from the target phase to the first actual phase side (advance angle side) by the set angle in the operation direction in which the deviation is reduced. In addition, the phase controller executes the first phase control of reducing the deviation between the first target phase and the current first actual phase detected by the phase detection unit. Thus, even when there is a delay in detection by the phase detection unit or when there is a delay in control by the phase controller, it is possible to prevent mechanical contact in the stopper unit by reducing the speed of displacement before the relative rotation phase reaches the first target phase. Or, even if the contact occurs, it is possible to reduce impact caused when the contact is made in the stopper unit. This control may also be performed in the same manner to reduce impact even when the target phase is set to the most advanced angle phase.

Therefore, the control apparatus is configured, which does not generate impulsive sound even when the target phase is set to the most retarded angle phase or the most advanced angle phase.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, an embodiment disclosed here will be described with reference to the accompanying drawings.

[Basic Configuration]

Figure 1:
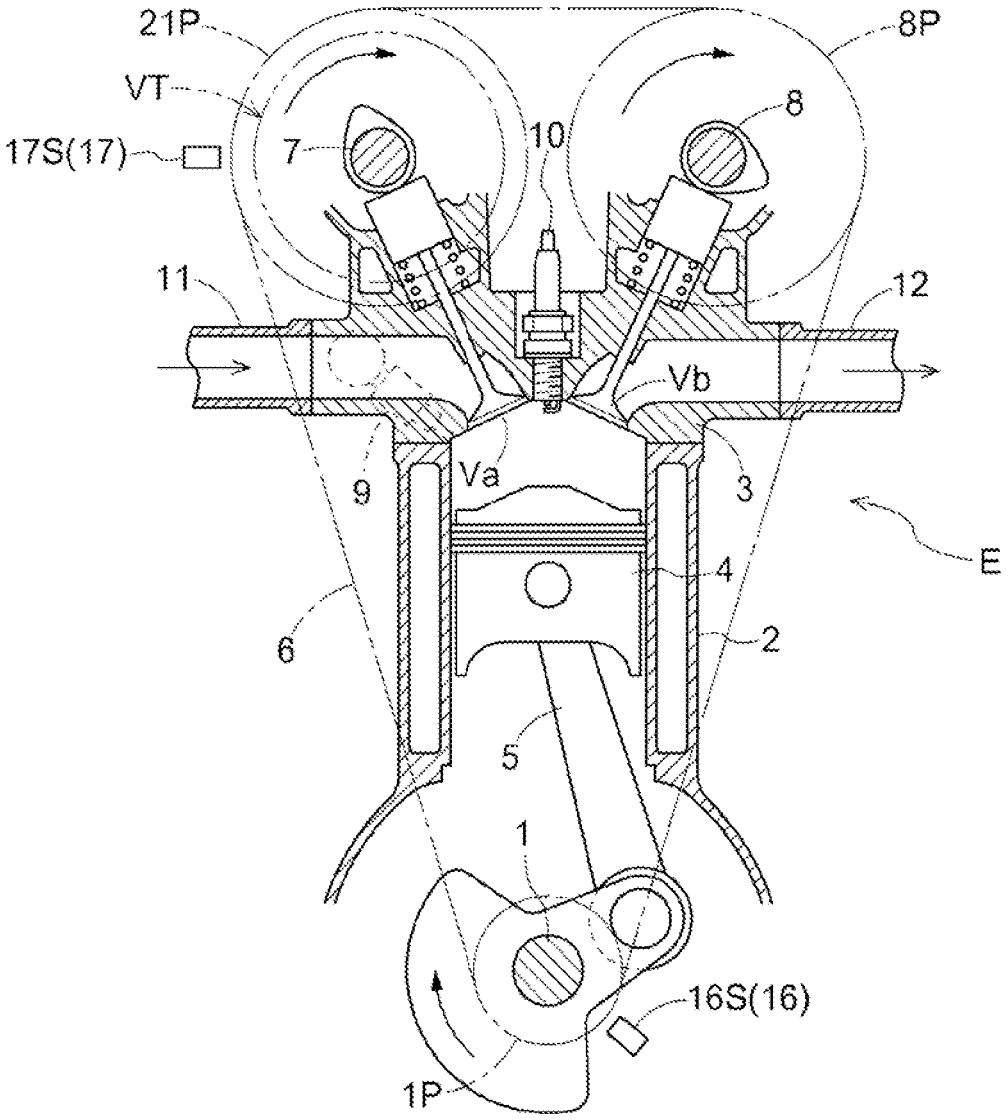
FIG. 1 is a cross-sectional view of an engine.
Figure 2:
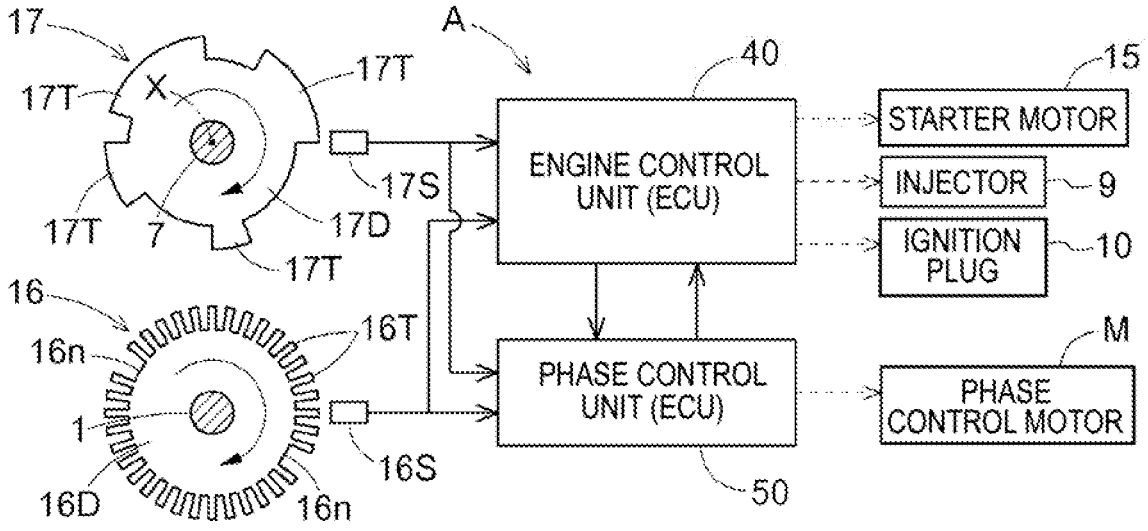
FIG. 2 is a block diagram of a control apparatus.

An engine E as an internal combustion engine is configured as illustrated in FIG. 1, and an engine control apparatus A that controls the engine E is configured as illustrated in FIG. 2.

The engine control apparatus A includes an engine control unit 40 functioning as an ECU and a phase control unit 50 (an example of a control apparatus of a valve opening/closing timing control mechanism) functioning as an ECU. The engine control unit 40 realizes startup of the engine E, management of the engine E in an operating state, and stop of the engine E. The phase control unit 50 controls a phase control motor M (an example of an electric motor) of a valve opening/closing timing control mechanism VT in order to set the opening/closing timing (valve timing) of an intake valve Va by the valve opening/closing timing control mechanism VT.

[Engine]

Figure 3:
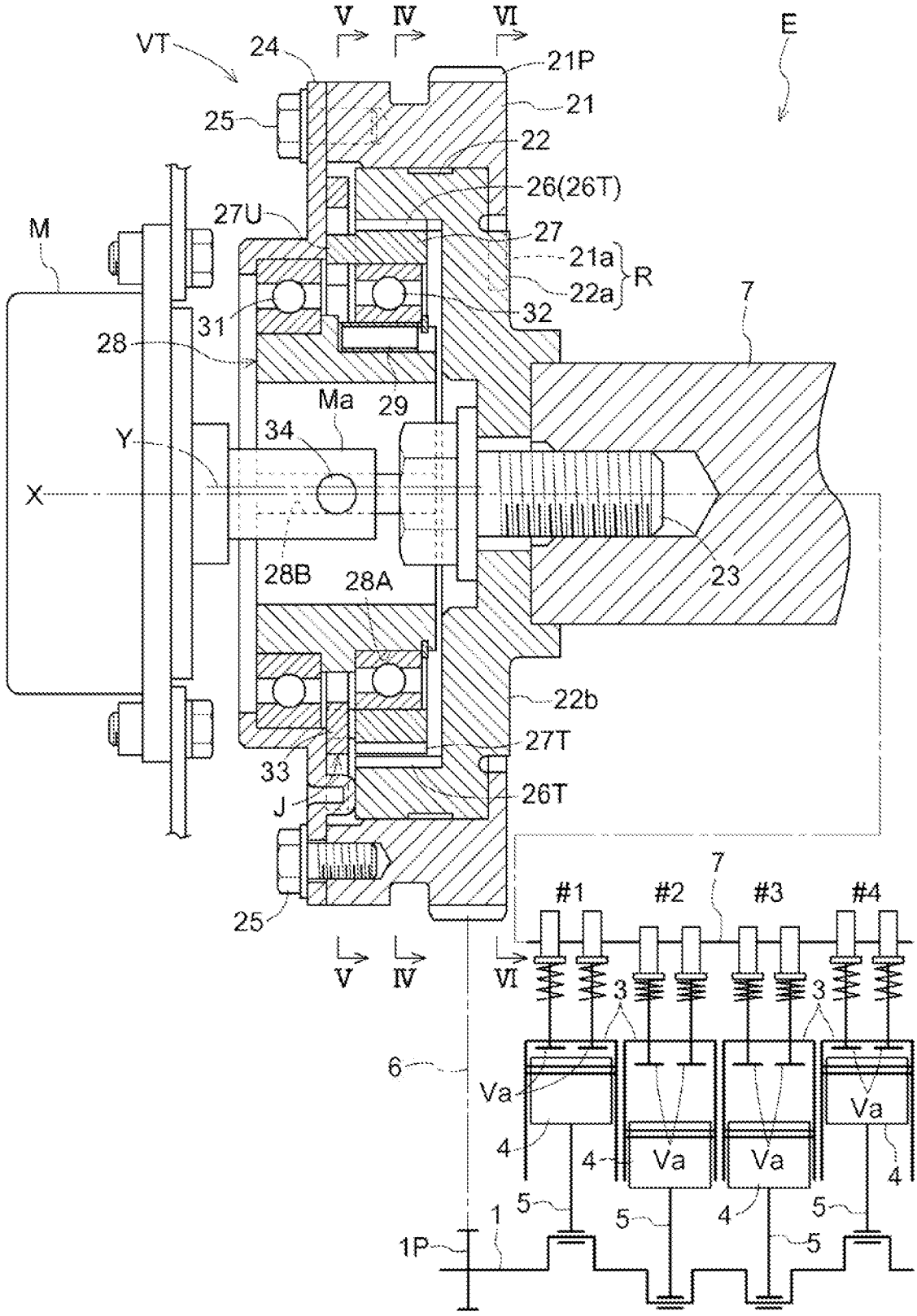
FIG. 3 is a cross-sectional view of a valve opening/closing timing control mechanism.

As illustrated in FIGS. 1 and 3, the engine E (an example of an internal combustion engine) is assumed to be provided in a vehicle such as a passenger car. The engine E is configured in a four-cycle form such that a cylinder head 3 is connected to an upper portion of a cylinder block 2 supporting a crankshaft 1, a piston 4 is slidably accommodated in each of a plurality of cylinder bores formed in the cylinder block 2, and the piston 4 is connected to the crankshaft 1 by a connecting rod 5.

In the engine E, a cylinder #1, a cylinder #2, a cylinder #3, and a cylinder #4 (illustrated as #1, #2, #3, and #4 in FIG. 3) are arranged from one end to the other end.

The cylinder head 3 is provided with the intake valve Va and an exhaust valve Vb. An intake camshaft 7 that controls the intake valve Va and an exhaust camshaft 8 that controls the exhaust valve Vb are provided in an upper portion of the cylinder head 3. A timing belt 6 is wound around an output pulley portion 1P of the crankshaft 1, a timing pulley portion 21P of a driving case 21 of the valve opening/closing timing control mechanism VT, and a driving pulley portion 8P of the exhaust camshaft 8.

The cylinder head 3 is provided with an injector 9 that injects fuel into a combustion chamber and an ignition plug 10. The cylinder head 3 is connected to an intake manifold 11 that supplies air to the combustion chamber via the intake valve Va and to an exhaust manifold 12 that sends a combustion gas from the combustion chamber via the exhaust valve Vb.

[Basic Configuration: Configuration of Sensors]

The engine E, as illustrated in FIGS. 1 and 2, is provided with a starter motor 15 that drives and rotates the crankshaft 1 and also provided, at a position in the vicinity of the crankshaft 1, with a crank angle sensor 16 that is capable of detecting the angle of rotation and the number of rotations per unit time. The engine E is provided with a cam angle sensor 17 that is capable of detecting the rotation phase of the intake camshaft 7.

Figure 8:
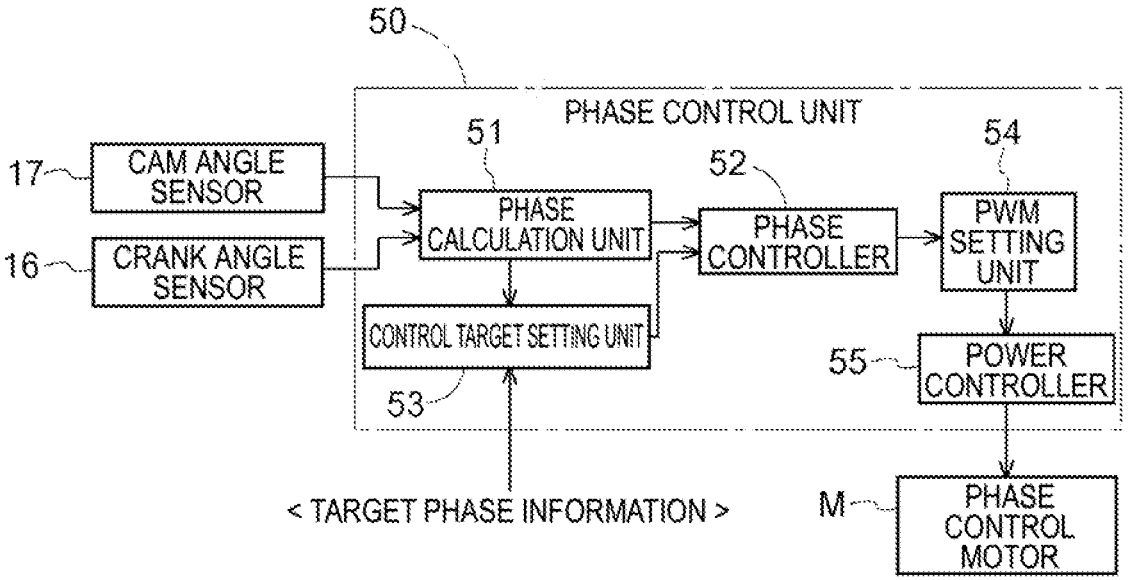
FIG. 8 is a block circuit diagram of a control unit.

A phase detection unit is constituted by the crank angle sensor 16, the cam angle sensor 17, and a phase calculation unit 51 illustrated in FIG. 8. In addition, a dedicated sensor that detects a relative rotation phase between the driving case 21 (driving side rotating body) and an inner rotor 22 (driven side rotating body) may be used as the phase detection unit.

According to this configuration, when starting the engine E by driving the starter motor 15, the opening/closing timing (valve timing) may be acquired by obtaining a relative rotation phase of the valve opening/closing timing control mechanism VT based on a detection result by the crank angle sensor 16 and a detection result by the cam angle sensor 17.

In the engine E, cylinder discrimination is performed by the engine control unit 40 based on a detection signal of the crank angle sensor 16 and a detection signal of the cam angle sensor 17. That is, as illustrated in FIG. 2, the crank angle sensor 16 is configured such that multiple teeth 16T are provided on the outer periphery of a disk portion 16D that rotates integrally with the crankshaft 1 and a crank sensor unit 16S is provided to detect the multiple teeth 16T. A reference point 16*n* where no teeth 16T are provided is formed at two positions on the outer periphery of the disk portion 16D. The reference point is made to coincide with the top dead center of a predetermined cylinder (e.g., the cylinder #1).

The disc portion 16D and the teeth 16T are integrally formed of a magnetic material and the crank sensor unit 16S of a pickup type is used. Thus, the crank sensor unit 16S detects each of the multiple teeth 16T with reference to the reference point 16*n* at the time of rotation of the crankshaft 1, and the rotation angle of the crankshaft 1 (the angle about the reference point 16*n*) is acquired by counting the number of detection times in the phase control unit 50.

As illustrated in FIG. 2, the cam angle sensor 17 is configured such that four detection areas 17T having a sector shape are provided on the outer periphery of a rotating body 17D that rotates integrally with the intake camshaft 7 and an intake cam sensor unit 17S that detects the detection areas 17T is provided. In addition, the four detection areas 17T have different lengths (circumferential lengths) respectively in four equally divided areas of the entire circumference of the rotating body 17D and enable discrimination of the four cylinders.

The rotating body 17D and the detection areas 17T are formed of a magnetic material, and the intake cam sensor unit 17S of a pickup type is used. When detecting the beginning end (detecting the up-edge) of the detection area 17T by the intake cam sensor unit 17S according to rotation of the intake camshaft 7, counting of a clock signal generated inside the phase control unit 50 is started, and when detecting the termination end (detecting the down-edge) of the detection area 17T, the counting is terminated, so that discrimination of the cylinders is possible based on the count value (integrated value) at the time of termination.

In particular, the cam angle sensor 17 is also configured to be able to detect the opening/closing timing (valve timing) of the valve opening/closing timing control mechanism VT. In other words, for example, considering a state where the valve opening/closing timing control mechanism VT is at the most retarded angle, the count value of the crank angle sensor 16 at the detection timing when detecting the end of one preset detection area 17T among the four detection areas 17T is a value corresponding to the most retarded angle phase.

In addition, when the relative rotation phase (the relative rotation phase between the driving case 21 and the inner rotor 22 illustrated in FIG. 3) of the valve opening/closing timing control mechanism VT is displaced from a most retarded angle phase to an intermediate phase, the count value of the crank angle sensor 16 at the above-described detection timing also changes, so that detection of the opening/closing timing is possible from the amount of change (difference/offset value).

Figure 4:
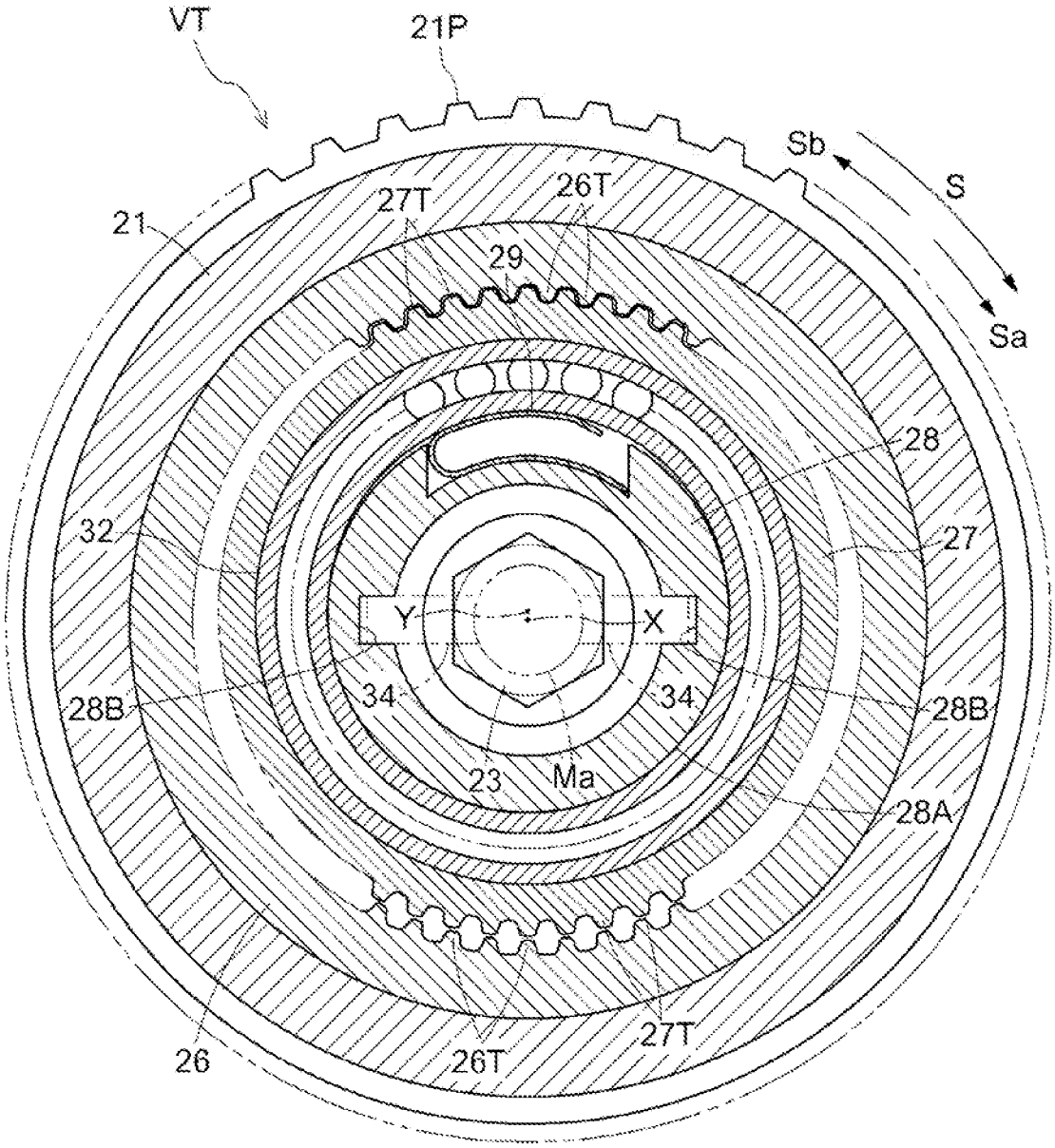
FIG. 4 is a cross-sectional view taken along line IV-IV of FIG. 3.
Figure 5:
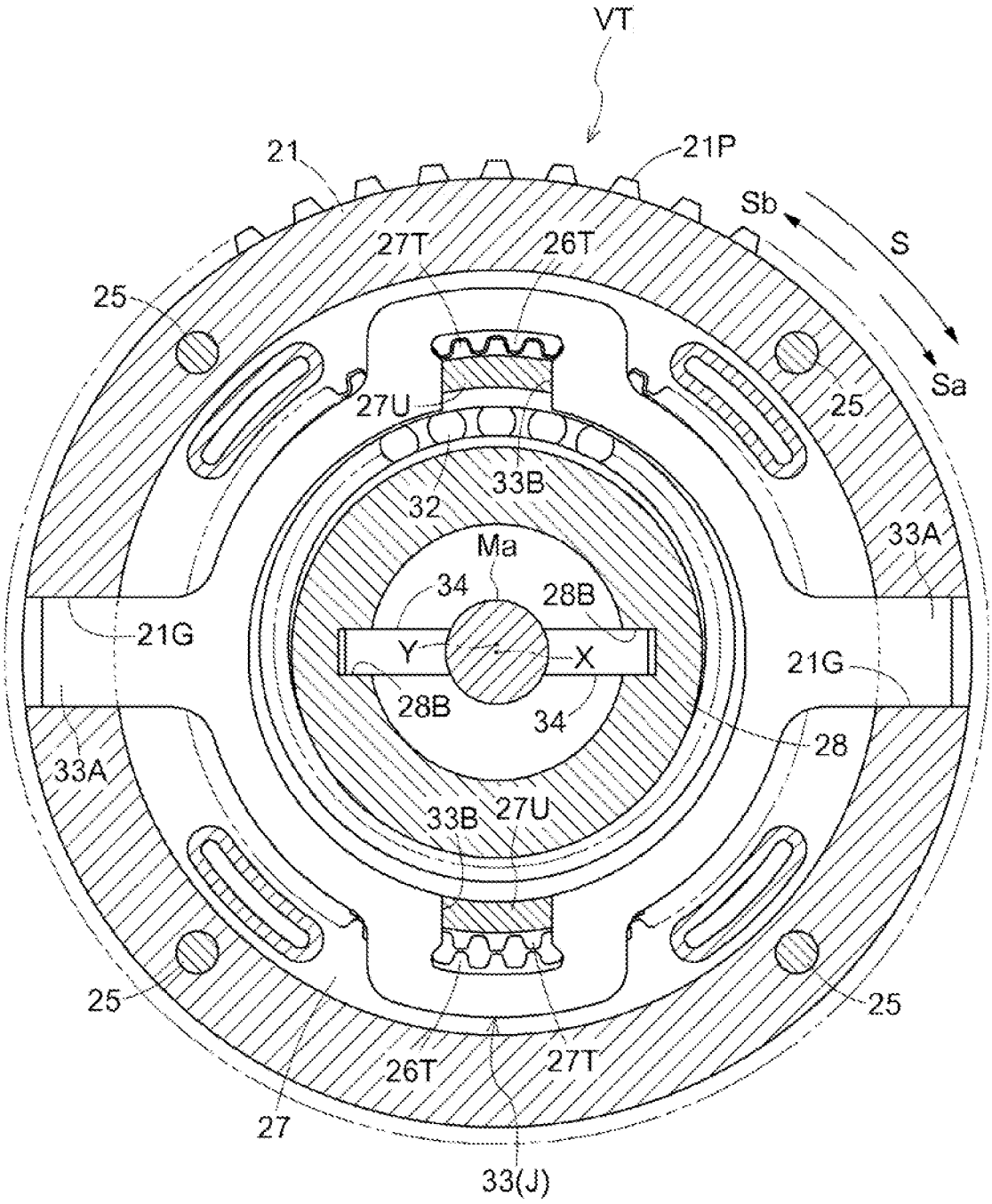
FIG. 5 is a cross-sectional view taken along line V-V of FIG. 3.
Figure 6:
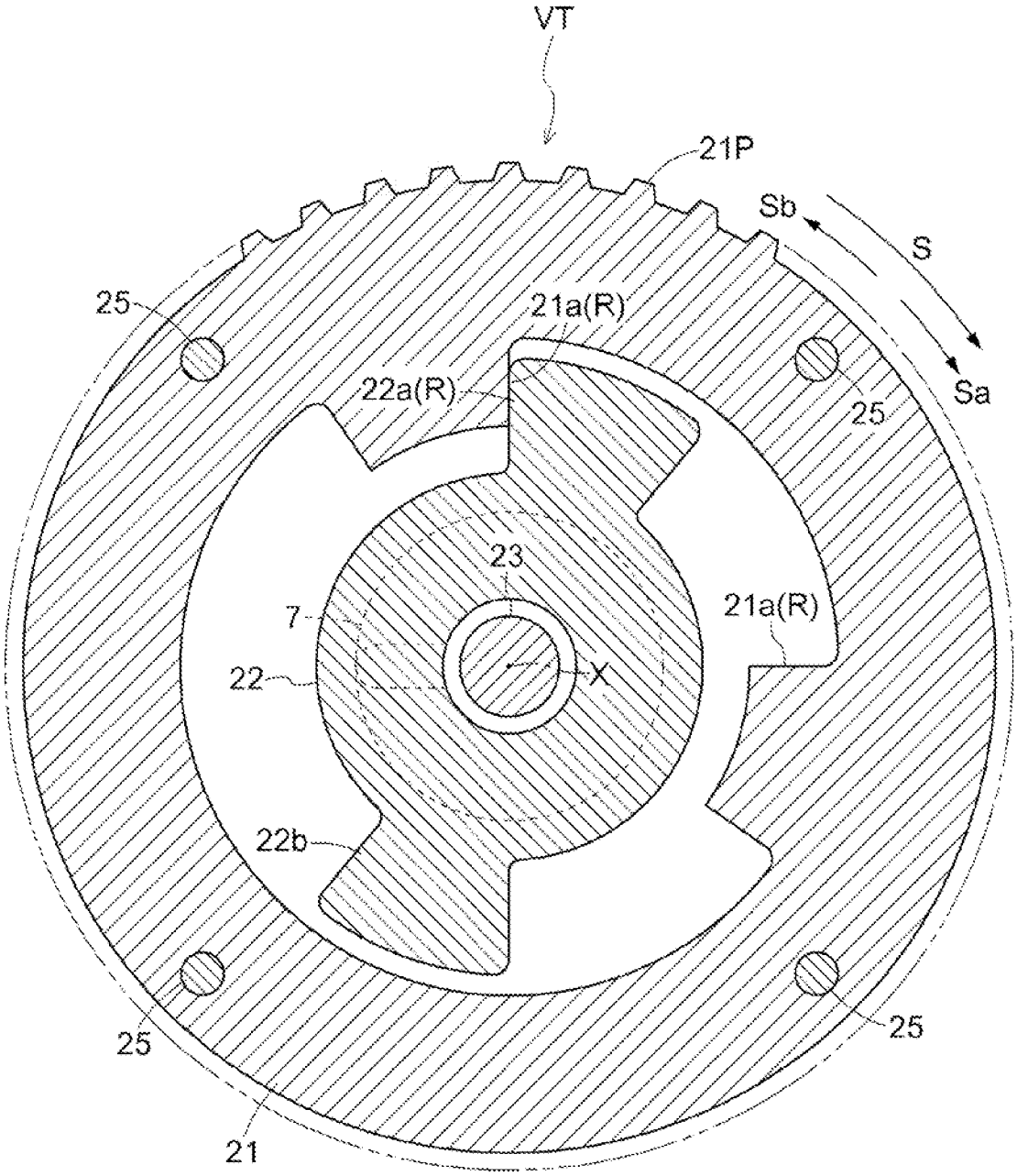
FIG. 6 is a cross-sectional view taken along line VI-VI of FIG. 3.

In addition, as illustrated in FIGS. 4 to 6, the most retarded angle is a phase that is a limit when the relative rotation phase of the valve opening/closing timing control mechanism VT is displaced in a retardation angle direction Sb. In addition, a phase that is a limit when the relative rotation phase is displaced in an advance angle direction Sa is referred to as a most advanced angle phase.

[Valve Opening/Closing Timing Control Mechanism]

As illustrated in FIGS. 3 to 7, the valve opening/closing timing control mechanism VT includes the driving case 21 (an example of the driving side rotating body) and the inner rotor 22 (an example of the driven side rotating body), and is provided with a phase adjustment unit that sets the relative rotation phase by driving the phase control motor M (an example of the electric motor). A brushless DC motor is used as the phase control motor M, so that the rotational speed of the motor increases as the voltage of power to be supplied increases.

The driving case 21 is disposed coaxially with a rotation axis X of the intake camshaft 7 and is formed on the outer periphery thereof with the timing pulley portion 21P. The inner rotor 22 is enclosed by the driving case 21 so as to be rotatable relative thereto and is connected and fixed to the intake camshaft 7 by a connection bolt 23. The phase adjustment unit is disposed between the driving case 21 and the inner rotor 22, and a front plate 24 is disposed at a position at which it covers an opening portion of the driving case 21 and is fastened to the driving case 21 by a plurality of fastening bolts 25.

The entire valve opening/closing timing control mechanism VT rotates in a driving rotation direction S illustrated in FIGS. 4 and 5 by a driving force from the timing belt 6. In addition, a direction in which the relative rotation phase of the inner rotor 22 with respect to the driving case 21 is displaced in the same direction as the driving rotation direction S by a driving force of the phase control motor M is referred to as the advance angle direction Sa and displacement in the opposite direction is referred to as the retardation angle direction Sb.

In addition, the amount of intake air at the intake valve Va is increased by displacing the relative rotation phase in the advance angle direction Sa. Conversely, the amount of intake air at the intake valve Va is reduced by displacing the relative rotation phase in the retardation angle direction Sb.

[Valve Opening/Closing Timing Control Mechanism: Phase Adjustment Unit]

As illustrated in FIGS. 3 to 7, the phase adjustment unit is constituted by the inner rotor 22, a ring gear 26 formed on the inner periphery of the inner rotor 22, an inner gear 27, an eccentric cam body 28, and a joint unit J. The ring gear 26 is formed on the inner periphery of the inner rotor 22 with a plurality of inner teeth 26T about the rotation axis X. The inner gear 27 is formed on the outer periphery thereof with a plurality of outer teeth 27T and is disposed coaxially with an eccentric axis Y having a posture parallel to the rotation axis X so that the outer teeth 27T on a portion thereof are meshed with the inner teeth 26T on a portion of the ring gear 26.

Figure 7:
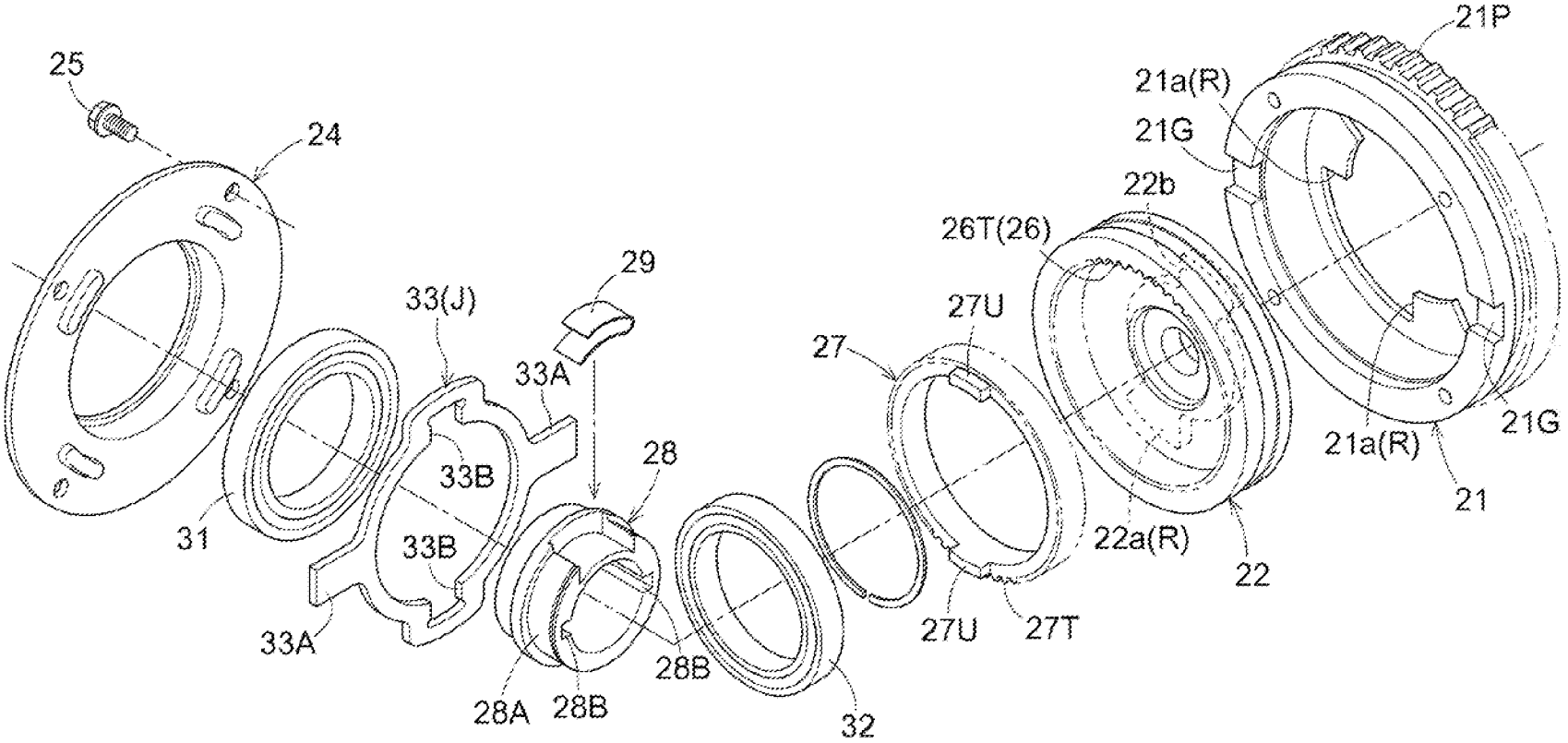
FIG. 7 is an exploded perspective view of the valve opening/closing timing control mechanism.

In particular, as illustrated in FIGS. 6 and 7, a stopper unit R is provided to determine a mechanical operation limit when the relative rotation phase of the inner rotor 22 with respect to the driving case 21 reaches the most retarded angle phase and when the relative rotation phase reaches the most advanced angle phase. The stopper unit R is constituted by a pair of regulation portions 21*a* protruding in the inner circumferential direction from the driving case 21 and a contact piece 22*a* formed on the end of the inner rotor 22 at a position at which it may come into contact with the regulation portion 21*a*. In addition, the inner rotor 22 is formed with a balancer 22*b* at a position opposite to the contact piece 22*a* with the rotation axis X interposed therebetween.

In the phase adjustment unit, the number of teeth of the outer teeth 27T of the inner gear 27 is smaller by only one than the number of teeth of the inner teeth 26T of the ring gear 26.

In addition, the joint unit J is configured as an Oldham's coupling that prevents the relative rotation between the driving case 21 and the inner rotor 22 while allowing the inner rotor 22 to be displaced in the direction orthogonal to the rotation axis X with respect to the driving case 21.

The eccentric cam body 28 is supported by a first bearing 31 with respect to the front plate 24 so as to rotate coaxially with the rotation axis X. The eccentric cam body 28 is integrally formed with an eccentric cam surface 28A that is centered on the eccentric axis Y having a posture parallel to the rotation axis X, and the inner gear 27 is rotatably supported with respect to the eccentric cam surface 28A via a second bearing 32. In addition, a spring body 29 is fitted into a recess formed in the eccentric cam surface 28A, and a pressing force of the spring body 29 acts on the inner gear 27 via the second bearing 32.

The eccentric cam body 28 has a tubular shape as a whole, and is formed on the inner periphery thereof with a pair of engaging grooves 28B in a posture parallel to the rotation axis X. Thus, some of the outer teeth 27T of the inner gear 27 are meshed with some of the inner teeth 26T of the ring gear 26.

The joint unit J includes a joint member 33 formed by press working a plate. A pair of engaging arms 33A formed on the joint member 33 are engaged with engaging grooves 21G in the driving case 21, and a pair of engaging recesses 33B formed in the joint member 33 are engaged with engaging protrusions 27U of the inner gear 27.

Meanwhile, the joint member 33 has a structure in which a central portion thereof is formed in an annular shape, the pair of engaging arms 33A protrude outward from the annular central portion, and the pair of engaging recesses 33B are formed so as to be connected to the space in the annular central portion.

In the joint unit J, the joint member 33 is displaceable in a straight direction that interconnects the pair of engaging grooves 21G in the driving case 21, and the inner gear 27 is displaceable in a straight direction that interconnects the pair of engaging protrusions 27U with respect to the joint member 33.

The phase control motor M is supported by the engine E and is provided with an engaging pin 34 having a posture orthogonal to an output shaft Ma, and the engaging pin 34 is fitted into the engaging groove 28B in the inner periphery of the eccentric cam body 28.

Thus, considering an operation mode in a state where the engine E stops, when the eccentric cam body 28 is rotated by the driving force of the phase control motor M, the eccentric cam surface 28A rotates about the rotation axis X, and the inner gear 27 starts to revolve around the rotation axis X according to the rotation. Since the meshed position between the outer teeth 27T of the inner gear 27 and the inner teeth 26T of the ring gear 26 is displaced along the inner periphery of the ring gear 26 during the revolution, a force acts on the inner gear 27 to rotate the inner gear 27 about the eccentric axis Y.

Then, when the inner gear 27 revolves only once, a rotation force (rotation force on the axis) that tries to rotate the ring gear 26 with respect to the inner gear 27 by an angle (angle corresponding to one tooth) corresponding to a difference (difference of the number of teeth) between the number of the inner teeth 26T of the ring gear 26 and the number of the outer teeth 27T of the inner gear 27 acts between the inner gear 27 and the ring gear 26.

As described above, since the joint unit J has a structure of regulating the rotation of the inner gear 27 with respect to the driving case 21, the inner gear 27 does not rotate with respect to the driving case 21, the ring gear 26 rotates with respect to the driving case 21 by the rotation force acting on the inner gear 27, and the inner rotor 22 relatively rotates integrally with the ring gear 26, so that adjustment of the rotation phase of the intake camshaft 7 with respect to the driving case 21 is realized.

Particularly, when the inner gear 27 revolves only once around the rotation axis X, since the intake camshaft 7 is rotated with respect to the driving case 21 by an angle corresponding to the difference (difference of the number of teeth) between the number of the outer teeth 27T of the inner gear 27 and the number of the inner teeth 26T of the ring gear 26, adjustment with a large reduction ratio is realized.

[Overview of Phase Adjustment]

When performing the phase adjustment of the valve opening/closing timing control mechanism VT, the phase control unit 50 drives and rotates the output shaft Ma of the phase control motor M in the same direction as that of the intake camshaft 7 and at the same speed as the rotational speed of the intake camshaft 7, whereby the relative rotation phase between the driving case 21 and the inner rotor 22 is maintained.

In addition, the phase control unit 50 performs displacement of the relative rotation phase in the advance angle direction Sa or in the retardation angle direction Sb by increasing or decreasing the rotational speed of the phase control motor M with reference to the rotational speed of the intake camshaft 7. With this control of the relative rotation phase, as described above, control is performed in a form such that the relative rotation phase of the valve opening/closing timing control mechanism VT is acquired based on information from the crank angle sensor 16 and the cam angle sensor 17 and the acquired relative rotation phase is fed back.

[Engine Control Unit and Phase Control Unit]

The engine control unit 40 is provided with an engine controller that is configured with software so as to control the engine E from startup to stop by controlling the starter motor 15, the injector 9, and the ignition plug 10.

As illustrated in FIG. 8, the phase control unit 50 includes a phase calculation unit 51, a phase controller 52, a control target setting unit 53, a PWM setting unit 54, and a power controller 55.

In the phase control unit 50, although the phase calculation unit 51, the phase controller 52, the control target setting unit 53, and the PWM setting unit 54 are configured with software, these components may be configured with hardware such as, for example, a logic or a memory, or may be configured by combining software and hardware with each other.

The phase calculation unit 51 calculates a current relative rotation phase between the driving case 21 (driving side rotating body) and the inner rotor 22 (driven side rotating body) by acquiring detection signals of the cam angle sensor 17 and the crank angle sensor 16, and provides the calculated current relative rotation phase to the phase controller 52. The control target setting unit 53 sets a target relative rotation phase by acquiring target phase information from the outside (e.g., the engine control unit 40), and provides the target phase as a control target to the phase controller 52.

The phase controller 52 obtains a deviation from the control target acquired from the control target setting unit 53 simultaneously with acquisition of the current relative rotation phase between the driving case 21 and the inner rotor 22 from the phase calculation unit 51, and sets target power corresponding to the deviation. The PWM setting unit 54 outputs a PWM control signal to the power controller 55 based on the target power from the phase controller 52, and the power controller 55 supplies power to the phase control motor M. In addition, the PWM setting unit 54 controls power by pulse width modulation (PWM) that turns on or off power supplied from a power supply at a fixed cycle by a switching element, for example, and sets the ON time during the cycle.

In the phase control unit 50, a control form in the phase controller 52 is set so as to increase the power (voltage and current) to be supplied to the phase control motor M as the deviation increases and to reduce the power to be supplied to the phase control motor M as the deviation decreases by performing proportional-integral-differential (PID) control.

The control form in the phase controller 52 is not limited to the PID control, but may be configured to perform, for example, only P control, only I control, or only D control.

In addition, in the valve opening/closing timing control mechanism VT, when maintaining the relative rotation phase during the operation of the engine E, control is performed to rotate the phase control motor M at the same speed as the intake camshaft 7. Thus, for example, when the deviation is obtained from the current relative rotation phase and the control target and the target power corresponding to the deviation is set, power of a value obtained by adding or subtracting power corresponding to the deviation to or from power that rotates the phase control motor M at the same speed as the intake camshaft 7 is supplied to the phase control motor M.

[Control Form]

Figure 9:
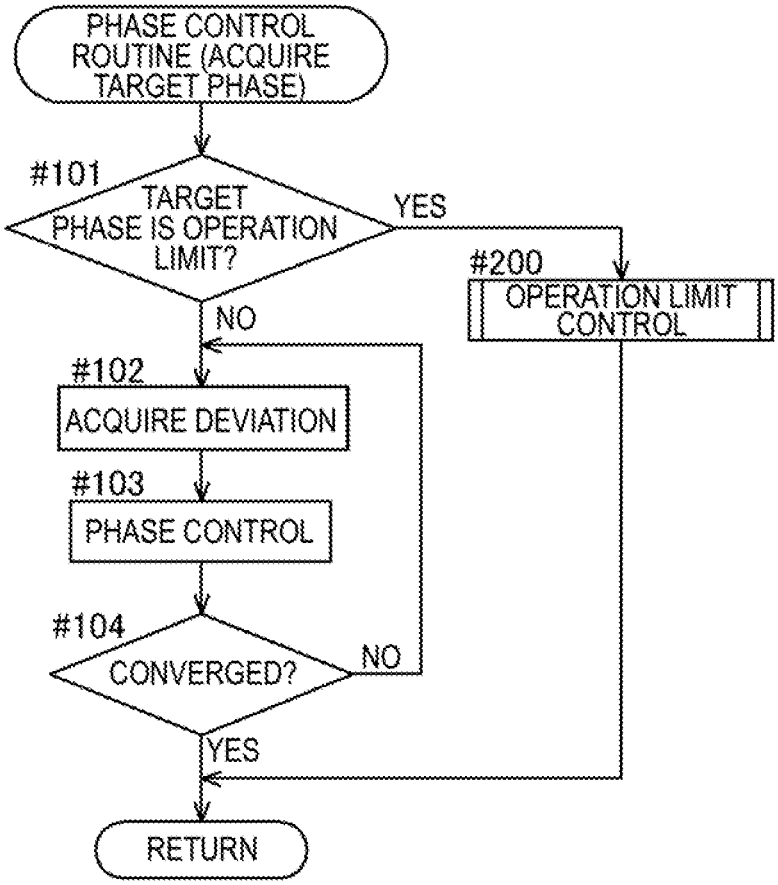
FIG. 9 is a flowchart of a phase control routine.

When acquiring a new target phase, the phase control unit 50 executes a phase control routine illustrated in the flowchart of FIG. 9.

As described above, in the valve opening/closing timing control mechanism VT, when the relative rotation phase is the most retarded angle phase or the most advanced angle phase, the regulation portion 21*a* and the contact piece 22*a* which constitute the stopper unit R come into contact with each other. When the contact state is an operation limit and a target phase is not the operation limit (step #101), a deviation between the current relative rotation phase detected by the phase detection sensor and the target phase is acquired, and phase control in which the phase controller 52 sets the power to be supplied to the phase control motor M based on the acquired deviation is performed until convergence (steps #102 to #104).

In addition, when it is determined in step #101 that the target phase is the operation limit (the most retarded angle phase or the most advanced angle phase), operation limit control (step #200) is executed.

Figure 10:
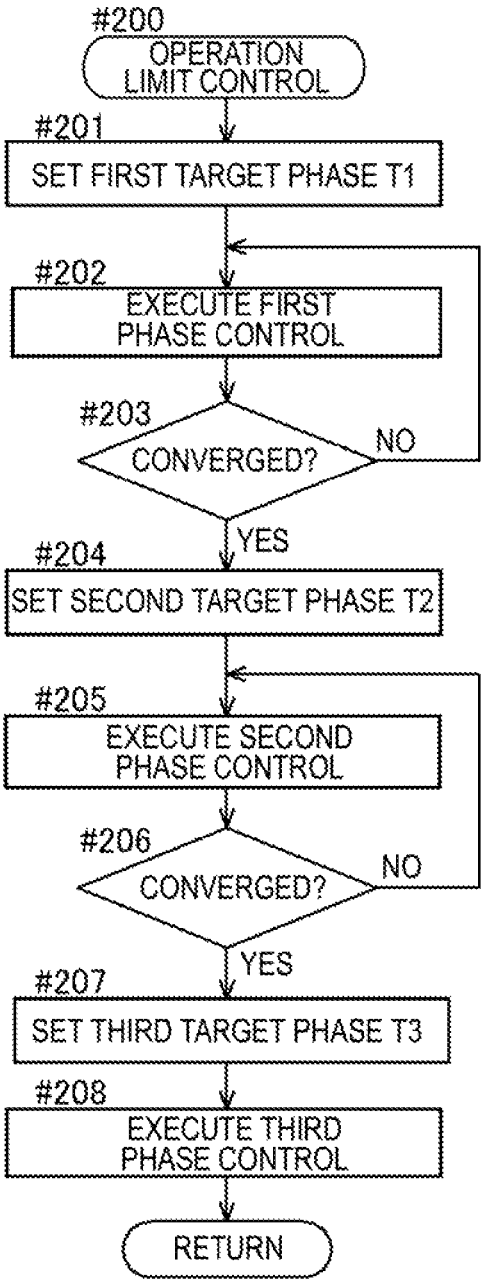
FIG. 10 is a flowchart of operation limit control.
Figure 11A:
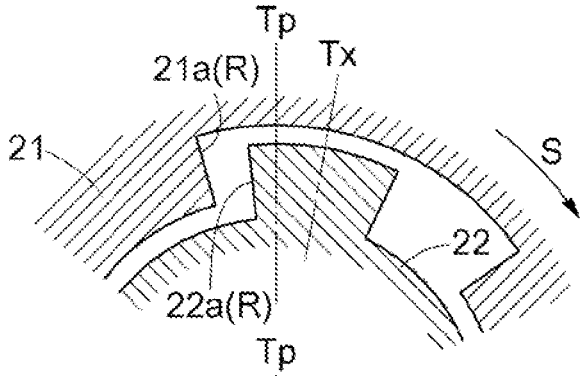
FIGS. 11A-11E are diagrams illustrating positional relationships between a regulation unit and a contact piece in operation limit control.
Figure 11B:
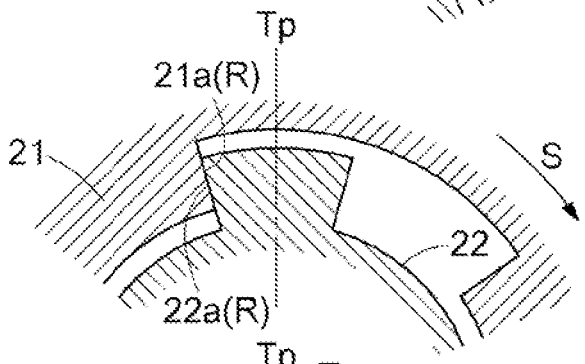
Figure 11C:
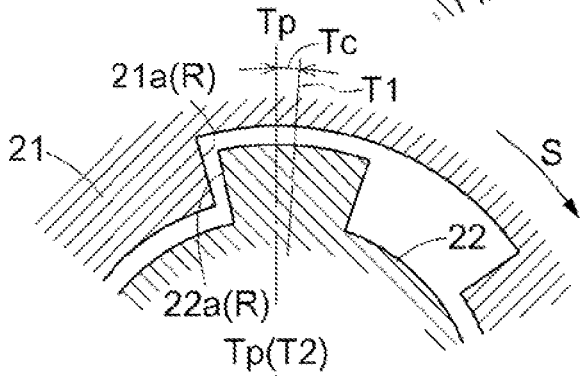
Figure 11D:
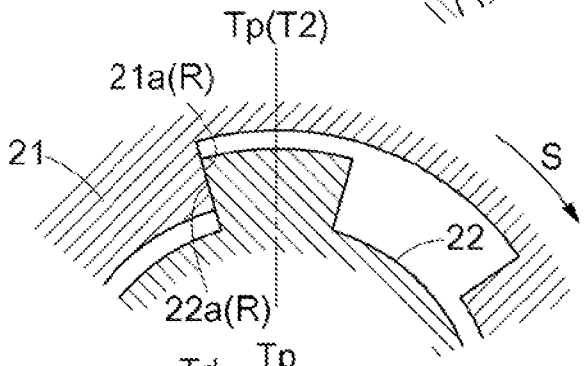
Figure 11E:
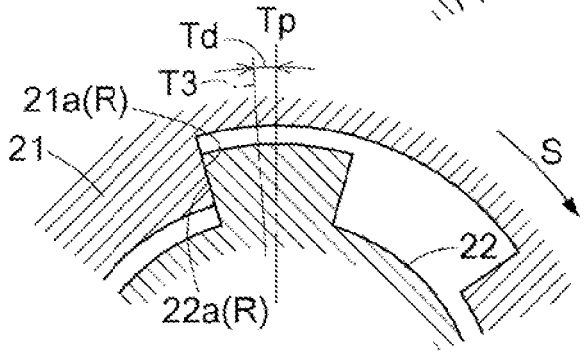

In the operation limit control (step #200), first, as illustrated in the flowchart of FIG. 10, the control target setting unit 53 sets a first target phase T1, and the phase controller 52 drives the phase control motor M so as to converge the deviation between the current relative rotation phase detected by the phase detection sensor and the first target phase T1, and continues the driving until the first phase control converges (steps #201 to #203). Here, "the deviation converges" means that the relative rotation phase reaches within ±3° CA with respect to the target phase, and "the phase control converges" means convergence of phase control according to the convergence of the deviation.

The uppermost stage (a) of FIG. 11 illustrates a current first actual phase Tx in which the relative rotation phase is not at the operation limit. In FIG. 11, the second stage (b) from the top illustrates a target phase Tp which is the operation limit (e.g., the most retarded angle phase). The current first actual phase Tx illustrated in FIG. 11 illustrates an arbitrary relative rotation phase before the phase control according to the present embodiment is started.

In addition, the third stage (c) (middle stage) illustrates the first target phase T1. As illustrated, the control target setting unit 53 sets the first target phase T1 to an angle by which the relative rotation phase is displaced by a set angle Tc from the target phase Tp to the first actual phase side (in the clockwise direction in FIG. 11) in an operation direction in which the deviation is reduced in the phase control with reference to the target phase Tp. When the relative rotation phase is displaced from the first actual phase Tx to the first target phase T1 by the phase control and the phase control converges, a gap is necessarily formed between the contact piece 22*a* and the regulation portion 21*a* of the stopper unit R. In addition, note that the first actual phase Tx is at the upstream side of the first target phase T1 (in the clockwise direction in FIG. 11).

As described above, since the phase controller 52 sets the target power corresponding to the deviation between the current first actual phase acquired from the phase detection unit and the target phase, when the first phase control converges, the relative speed between the driving case 21 and the inner rotor 22 is extremely low.

Next (after the first phase control has converged), the control target setting unit 53 sets a second target phase T2, and the phase controller 52 drives the phase control motor M so as to converge the deviation between the current relative rotation phase (first target phase T1) detected by the phase detection sensor and the second target phase T2, and continues the driving until the second phase control converges (steps #204 to #206).

The fourth stage (d) (second stage from the bottom) of FIG. 11 illustrates the second target phase T2. The control target setting unit 53 sets the second target phase T2 to the same rotation phase as the target phase Tp. In addition, since the second phase control is executed after the first phase control has converged and the angular difference between the second target phase T2 and the first target phase T1 (an example of a current second actual phase) is small, the deviation is small even immediately after the second phase control is started, the relative speed between the driving case 21 and the inner rotor 22 does not increase, the contact piece 22*a* and the regulation portion 21*a* of the stopper unit R do not come into contact with each other at a high speed, and the generation of impulsive sound is also prevented because no impact occurs at the time of contact.

Thereafter (after the second phase control has converged), the control target setting unit 53 sets a third target phase T3, and the phase controller 52 drives the phase control motor M so as to converge the deviation between the current relative rotation phase (the second target phase T2) detected by the phase detection sensor and the third target phase T3 (steps #207 and #208).

The fifth stage (e) (the lowermost stage) of FIG. 11 illustrates the third target phase T3. The control target setting unit 53 sets the third target phase T3 to an angle by which the relative rotation phase is displaced by a predetermined angle Td from the second target phase T2 to the side opposite to the first actual phase (in the counterclockwise direction in FIG. 11) in an operation direction in which the deviation is reduced in the second phase control with reference to the second target phase T2 (equal to the target phase Tp: an example of a current third actual phase).

In the third phase control, although the control does not converge because the relative rotation phase reaches a mechanical limit at which the contact piece 22*a* and the regulation portion 21*a* of the stopper unit R come into contact with each other, driving is continued by the driving force of the phase control motor M to maintain a state where the contact piece 22*a* and the regulation portion 21*a* are in contact with each other. Therefore, the phenomenon that the contact piece 22*a* and the regulation portion 21*a* are separated from each other is prevented even if a cam fluctuating torque acts, and the generation of impulsive sound is also prevented.

[Action Effects of Embodiment]

In this way, when the target phase Tp is set so as to set the relative rotation phase to the most retarded angle phase or the most advanced angle phase, by setting the first target phase T1 instead of the target phase Tp to execute the first phase control, it is possible to converge the control in a state where the regulation portion 21*a* and the contact piece 22*a* of the stopper unit R do not come into contact with each other.

Next, since the regulation portion 21*a* and the contact piece 22*a* of the stopper unit R are slowly brought into contact by setting the second target phase T2 to execute the second phase control, it is possible to prevent the generation of impulsive sound. In addition, after the second phase control has converged, by setting the third target phase T3 to execute the third phase control, it is possible to maintain the state where the regulation portion 21*a* and the contact piece

22*a* of the stopper unit R are in contact with each other and to prevent the generation of impulsive sound caused when the regulation portion 21*a* and the contact piece 22*a* repeatedly come into contact with each other.

This disclosure may be applied to a valve opening/closing timing control mechanism that controls the opening/closing timing of a valve of a combustion chamber of an internal combustion engine by an electric motor.

According to this characteristic configuration, for example, when the most retarded angle phase is set as the target phase, the control target setting unit sets, instead of the target phase, the first target phase displaced from the target phase to the first actual phase side (advance angle side) by the set angle in the operation direction in which the deviation is reduced. In addition, the phase controller executes the first phase control of reducing the deviation between the first target phase and the current first actual phase detected by the phase detection unit. Thus, even when there is a delay in detection by the phase detection unit or when there is a delay in control by the phase controller, it is possible to prevent mechanical contact in the stopper unit by reducing the speed of displacement before the relative rotation phase reaches the first target phase. Or, even if the contact occurs, it is possible to reduce impact caused when the contact is made in the stopper unit. This control may also be performed in the same manner to reduce impact even when the target phase is set to the most advanced angle phase.

Therefore, the control apparatus is configured, which does not generate impulsive sound even when the target phase is set to the most retarded angle phase or the most advanced angle phase.

Another feature of the control apparatus resides in that, when it is determined that the relative rotation phase reached the first target phase by execution of the first phase control, the control target setting unit sets the target phase to a second target phase instead of the first target phase, and the phase controller may execute a second phase control that is a phase control of reducing a deviation between the set second target phase and a current second actual phase.

According to this configuration, since the speed of displacement of the relative rotation phase is greatly reduced when the relative rotation phase reaches the first target phase by the execution of the first phase control, and in this state, the target phase is set to the second target phase as an original control target, the deviation at the time of starting the second phase control is small, and even if the relative rotation phase reaches the second target phase (original control target) by the execution of the second phase control, mechanical contact in the stopper unit may be slowly performed and the generation of impulsive sound may be prevented.

Another feature of the control apparatus resides in that, after it is determined that the relative rotation phase reached the second target phase by execution of the second phase control, the control target setting unit sets, instead of the second target phase, a third target phase displaced from the target phase to a side opposite to the first actual phase by a predetermined angle in the operation direction where the deviation is reduced, and the phase controller may execute a third phase control that is a phase control of reducing a deviation between the set third target phase and a current third actual phase.

According to this configuration, by setting the third target phase at the downstream side of the original target phase in the operation direction in which the deviation is reduced after the relative rotation phase has reached the original control target by the execution of the second phase control, the electric motor is driven so as to continuously displace the relative rotation phase in the direction in which the contact state is maintained by the execution of the third phase control even in a state where the stopper unit is in a mechanical contact state. As a result, the mechanical contact state is maintained in the stopper unit, and even if a cam fluctuating torque acts, no contact sound is generated in the stopper unit.

Another feature of the control apparatus resides in that the second target phase is the most retarded angle phase or the most advanced angle phase.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A control apparatus of a valve opening/closing timing control mechanism configured by including a driving side rotating body configured to rotate synchronously with rotation of a crankshaft of an internal combustion engine;

a driven side rotating body configured to rotate integrally with a camshaft for opening or closing of a valve that opens or closes a combustion chamber;

a stopper unit configured to determine a mechanical operation limit on a most retarded angle side and a mechanical operation limit on a most advanced angle side of the driven side rotating body with respect to the driving side rotating body by virtue of a gap between a portion of the driven side rotating body and a portion of the driving rotating body corresponding to the stopper unit no longer being formed; and an electric motor configured to control a relative rotation phase between the driving side rotating body and the driven side rotating body, the control apparatus comprising:

a phase controller configured to control the electric motor to reduce, when a target phase is set, a deviation between the target phase and a current first actual phase detected by a phase detection unit that detects the relative rotation phase and to reduce power to be supplied to the electric motor as the deviation decreases; and a control target setting unit configured to set, instead of the target phase, a first target phase displaced from the target phase to a side of the first actual phase by a set angle in an operation direction in which the deviation is reduced when the target phase is set to a most retarded angle phase or a most advanced angle phase that is an operation limit of the stopper unit, wherein the phase controller executes a first phase control that is a phase control of reducing a deviation between the set first target phase and the current first actual phase, wherein, after convergence of the first phase control so that the relative rotation phase is displaced from the first actual phase to the first target phase, the gap between the portion of the driven side rotating body and the portion of the driving rotating body corresponding to the stopper unit is formed.

2. The control apparatus according to claim 1, wherein, when it is determined that the relative rotation phase reached the first target phase by execution of the first phase control, the control target setting unit sets the target phase to a second target phase instead of the first target phase, and the phase controller executes a second phase control that is a phase control of reducing a deviation between the set second target phase and a current second actual phase.

3. The control apparatus according to claim 2, wherein, after it is determined that the relative rotation phase reached the second target phase by execution of the second phase control, the control target setting unit sets, instead of the second target phase, a third target phase displaced from the target phase to a side opposite to the first actual phase by a predetermined angle in the operation direction where the deviation is reduced, and the phase controller executes a third phase control that is a phase control of reducing a deviation between the set third target phase and a current third actual phase.

4. The control apparatus according to claim 2, wherein the second target phase is the most retarded angle phase or the most advanced angle phase.

* * * * *